US006770231B2

(12) United States Patent
Klein

(10) Patent No.: US 6,770,231 B2
(45) Date of Patent: Aug. 3, 2004

(54) SPIN FINISH

(75) Inventor: Ralf Klein, Midlothian, VA (US)

(73) Assignee: Alliedsignal, Inc, Morristown, NJ (US)

( * ) Notice: Subject to any disclaimer, the term of this patent is extended or adjusted under 35 U.S.C. 154(b) by 450 days.

(21) Appl. No.: 10/145,945

(22) Filed: Oct. 26, 2001

(65) Prior Publication Data

US 2002/0171061 A1 Nov. 21, 2002

Related U.S. Application Data

(62) Division of application No. 09/287,834, filed on Apr. 7, 1999, now Pat. No. 6,365,065.

(51) Int. Cl.[7] ..... D06M 13/17; D06M 13/224; D06M 15/643

(52) U.S. Cl. ..... 264/103; 264/130; 264/211.14

(58) Field of Search ..... 264/103, 129, 264/130, 211.14

(56) References Cited

U.S. PATENT DOCUMENTS

| | | | |
|---|---|---|---|
| 3,446,734 | A | 5/1969 | Coats, Jr. |
| 3,681,244 | A | 8/1972 | Obetz et al. |
| 3,781,202 | A | 12/1973 | Marshall et al. |
| 3,940,544 | A | 2/1976 | Marshall et al. |
| 4,019,990 | A | 4/1977 | Marshall et al. |
| 4,108,781 | A | 8/1978 | Marshall et al. |
| 4,340,382 | A | 7/1982 | Morlino et al. |
| 4,348,517 | A | 9/1982 | Chakravarti |
| 4,351,738 | A | 9/1982 | Takahashi et al. |
| 4,371,658 | A | 2/1983 | Marshall et al. |
| 4,442,249 | A | 4/1984 | Lees et al. |
| 4,552,671 | A | 11/1985 | Ogiso et al. |
| 5,011,616 | A | 4/1991 | Marshall et al. |
| 5,132,067 | A | 7/1992 | Nelson et al. |
| 5,331,032 | A | 7/1994 | Suzuki et al. |
| 5,434,237 | A | 7/1995 | Weinelt et al. |
| 5,507,989 | A | 4/1996 | Makino et al. |
| 5,630,976 | A | 5/1997 | Nelson et al. |
| 5,869,582 | A | 2/1999 | Tang et al. |

FOREIGN PATENT DOCUMENTS

| | | | |
|---|---|---|---|
| GB | 1058796 | A | 2/1967 |
| WO | 94/14877 | A1 | 7/1994 |
| WO | 96/06971 | A1 | 3/1996 |
| WO | 96/21668 | A1 | 7/1996 |

OTHER PUBLICATIONS

"Practical Consideration in Finish Use" by Harry Billica, Fiber Producer/Aug. 1984/41.

"Update on Fiber Finishers: What's Happening Now? Why?" by Harry Billica, Fiber/Produce/Apr. 1984/21.

Abstract of WO 99/39041 (May 1999).

*Primary Examiner*—Leo B. Tentoni
(74) *Attorney, Agent, or Firm*—Roberts & Roberts, LLP

(57) ABSTRACT

The present spin finish composition comprises at least about 10 percent by weight based on the spin finish composition of components (a) and (b) having the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms or an alkylene hydroxy group having from one to 22 carbon atoms, x is zero or one, $R_2$ may vary within component (a) or component (b) and is selected from the group consisting of hydrogen or an alkyl group having from one to four carbon atoms, y is zero, or from one to 25, and z is zero or one, in component (a), x and z are equal to zero and the average molecular weight of component (a) is less than or equal to 1,900 and if $R_2$ varies, component (a) is a random copolymer; and in component (b), at least x or z is equal to one or component (b) is a complex polyoxyethylene glyceride-containing compound having greater than 10 polyoxyethylene units; and up to about five percent by weight based on the spin finish composition of component (c) of an ethoxylated silicone.

The present spin finish may be used on industrial yarn.

20 Claims, No Drawings

SPIN FINISH

CROSS REFERENCE TO RELATED APPLICATION

This application is a division of U.S. patent application Ser. No. 09/287,834 filed Apr. 7, 1999, now U.S. Pat. No. 6,365,065.

The present invention relates to an improved spin finish for synthetic fiber.

BACKGROUND OF THE INVENTION

Upon emerging from a spinneret, many synthetic fibers require the application of a spin finish in order to further process the spun yarn. Because a spin finish may be present in a minimal layer on fiber, the spin finish acts as an interface between the fiber and the metallic surfaces such as guides and rollers which contact the fiber during such processing as drawing or relaxing.

Spin finishes comprising polyalkylene glycols with molecular weights of 300 to 1,000 are taught by commonly assigned U.S. Pat. Nos. 3,940,544; 4,019,990; and 4,108,781. See also U.S. Pat. No. 4,351,738.

U.S. Pat. No. 4,340,382 teaches a spin finish comprising polyalkylene glycol which is a block copolymer. Unfortunately, spin finishes comprising polyalkylene glycol block copolymers may form deposits on the metallic surfaces which they contact during manufacturing.

Spin finishes comprising polyalkylene glycols with molecular weights of greater than 1,000 are taught by U.S. Pat. Nos. 4,351,738; 4,552,671; and 5,507,989. Unfortunately, spin finishes comprising these higher molecular weight polyalkylene glycols also may form deposits on the metallic surfaces which they contact during manufacturing.

U.S. Pat. No. 4,442,249 teaches a spin finish comprising an ethylene oxide/propylene oxide block copolymer with a molecular weight greater than 1,000 and a lubricant of an alkyl ester or dialkyl ester or polyalkyl ester of tri- to hexaethylene glycol. Unfortunately, spin finishes comprising these block copolymers also may form deposits on the metallic surfaces which they contact during manufacturing.

Commonly assigned U.S. Pat. Nos. 3,681,244; 3,781,202; 4,348,517; 4,351,738; and 4,371,658 teach the use of polyoxyethylene castor oil in spin finishes.

A spin finish which is non-depositing and stable is needed in the art.

SUMMARY OF THE INVENTION

We have developed a spin finish which responds to the foregoing need in the art. The present spin finish composition comprises at least about 10 percent by weight based on the spin finish composition of components (a) and (b) having the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms or an alkylene hydroxy group having from one to 22 carbon atoms, x is zero or one, $R_2$ may vary within component (a) or component (b) and is selected from the group consisting of hydrogen or an alkyl group having from one to four carbon atoms, y is zero, or from one to 25, and z is zero or one, in component (a), x and z are equal to zero and the average molecular weight of component (a) is less than or equal to 1,900 and if $R_2$ varies, component (a) is a random copolymer; and in component (b), at least x or z is equal to one or component (b) is a complex polyoxyethylene glyceride-containing compound having greater than 10 polyoxyethylene units; and up to five percent by weight based on the spin finish composition of component (c) of an alkoxylated silicone.

The present invention is advantageous because the spin finish is substantially non-depositing and stable.

Other advantages of the present invention will be apparent from the following description and attached claims.

DETAILED DESCRIPTION OF THE PREFERRED EMBODIMENTS

Component (a) of the present spin finish composition has the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms, x and z are zero, $R_2$ may vary and is selected from the group consisting of hydrogen or an alkyl group having from one to four carbon atoms, and y is zero, or from one to 25. The average molecular weight of component (a) is less than or equal to 1,900.

Preferably, the average molecular weight of component (a) is greater than 500. More preferably, the average molecular weight of component (a) is less than about 1,500.

Preferably, in component (a), each of $R_1$ and $R_3$ is selected from the group consisting of hydrogen or an alkyl group having from one to ten carbon atoms, $R_2$ varies and is selected from the group consisting of hydrogen and an alkyl group having one or two carbon atoms, and y is zero or between one to 20. The term "$R_2$ varies" means that $R_2$ may be hydrogen and methyl, hydrogen and ethyl, or methyl and ethyl. More preferably, in component (a), each of $R_1$ and $R_3$ is selected from the group consisting of hydrogen or an alkyl group having from one to five carbon atoms atoms, $R_2$ is selected from the group consisting of hydrogen and an alkyl group having one carbon atom, and y is zero or between one to 16.

Preferred component (a) is a so-called random copolymer, and more preferably, a random copolymer made from ethylene oxide and propylene oxide. Ethylene oxide and propylene oxide are reacted simultaneously to form mixed polyalkylene glycol compounds. Preferred compounds are condensation products of about 30 to about 70 percent by weight ethylene oxide and about 30 to about 70 percent by weight propylene oxide and are terminated with an alcohol having one to four carbon atoms. Useful random copolymers are commercially available.

Preferably, component (a) is present in an amount of at least about 10 percent by weight based on the spin finish composition. More preferably, component (a) is present in an amount of at least about 20 percent by weight based on the spin finish composition.

Component (b) of the present spin finish has the formula $$R_1—(CO)_x—O—(CH(R_2)—CH_2—O)_y—(CO)_z—R_3$$

wherein each of $R_1$ and $R_3$ is selected from the group consisting of hydrogen or an alkyl group having from one to 22 carbon atoms or an alkylene hydroxy group having from one to 22 carbon atoms, x is zero or one, $R_2$ may vary and is selected from the group consisting of hydrogen or an alkyl group having from one to four carbon atoms, z is zero or one, and at least x or z is equal to one. Component (b) may be a mixture of components or may be a complex polyoxyethylene glyceride-containing compound having greater than 10 polyoxyethylene units.

Preferably, in component (b), each of $R_1$ and $R_3$ is selected from the group consisting of hydrogen or an alkyl group having from one to 18 carbon atoms or alkylene hydroxy group having from one to 18 carbon atoms, $R_2$ does not vary and is selected from the group consisting of hydrogen or an alkyl group having one or two carbon atoms, and y is from 5 to 25. More preferably, in component (b), x is one and z is zero.

Useful complex esters are commercially available.

The most preferred component (b) is a polyoxyethylene glyceride-containing compound having greater than 10 polyoxyethylene units and the most preferred polyoxyethylene glyceride-containing compound having greater than 10 polyoxyethylene units is ethoxylated castor oil.

Preferably, component (b) is present in an amount of at least about five percent by weight based on the spin finish composition.

Component (c) is an alkoxylated silicone. Preferably, the alkoxylated silicone has a siloxane backbone with organic polyalkylene oxide pendants. Useful alkoxylated silicones are commercially available. The alkoxylated silicone is used in an amount of up to about five percent by weight based on the spin finish composition.

The present spin finish may be used on any synthetic fiber. Useful synthetic materials include polyesters and polyamides. Useful polyesters include linear terephthalate polyesters, i.e., polyesters of a glycol containing from 2 to 20 carbon atoms and a dicarboxylic acid component containing at least about 75% terephthalic acid. The remainder, if any, of the dicarboxylic acid component may be any suitable dicarboxylic acid such as sebacic acid, adipic acid, isophthalic acid, sulfonyl-4,4'-dibenzoic acid, or 2,8-dibenzofurandicarboxylic acid. The glycols may contain more than two carbon atoms in the chain, e.g., diethylene glycol, butylene glycol, decamethylene glycol, and bis-1,4-(hydroxymethyl)cyclohexane. Examples of linear terephthalate polyester include poly(ethylene terephthalate); poly (butylene terephthalate); poly(ethylene terephthalate/5-chloroisophthalate) (85/15); poly(ethylene terephthalate/5-[sodium sulfo]isophthalate)(97/3); poly(cyclohexane-1,4-dimethylene terephthalate), and poly(cyclohexane-1,4-dimethylene terephthalate/hexahydroterephthalate). These starting materials are commercially available.

Another useful polymer is the copolymer taught by commonly assigned U.S. Pat. No. 5,869,582. The copolymer comprises: (a) a first block of aromatic polyester having: (i) an intrinsic viscosity which is measured in a 60/40 by weight mixture of phenol and tetrachloroethane and is at least about 0.6 deciliter/gram and (ii) a Newtonian melt viscosity which is measured by capillary rheometer and is at least about 7,000 poise at 280° C.; and (b) a second block of lactone monomer. Examples of preferred aromatic polyesters include poly(ethylene terephthalate)("PET"), poly(ethylene naphthalate)("PEN"); poly(bis-hydroxymethylcyclohexene terephthalate); poly(bis-hydroxymethylcyclohexene naphthalate); other polyalkylene or polycycloalkylene naphthalates and the mixed polyesters which in addition to the ethylene terephthalate unit, contain components such as ethylene isophthalate, ethylene adipate, ethylene sebacate, 1,4-cyclohexylene dimethylene terephthalate, or other alkylene terephthalate units. A mixture of aromatic polyesters may also be used. Commercially available aromatic polyesters may be used. Preferred lactones include ϵ-caprolactone, propiolactone, butyrolactone, valerolactone, and higher cyclic lactones. Two or more types of lactones may be used simultaneously.

Useful polyamides include nylon 6; nylon 66; nylon 11, nylon 12, nylon 6,10, nylon 6,12, nylon 4,6, copolymers thereof, and mixtures thereof.

The synthetic fiber may be produced by known methods for making industrial fiber. For example, commonly assigned U.S. Pat. Nos. 5,132,067 and 5,630,976 teach methods for making dimensionally stable PET. After the synthetic fiber emerges from a spinneret, the present spin finish may be applied to the synthetic fiber by any known means including bath, spray, padding, and kiss roll applications. Preferably, the present spin finish is applied to the synthetic yarn in an amount of about 0.2 to about 1.5 percent by weight based on the weight of the synthetic yarn.

The following examples are illustrative and not limiting.

COMPARATIVE A AND INVENTIVE EXAMPLES 1 THROUGH 6

For Comparative A and Inventive Examples 1 through 6, commercially available components (a) and (b) having the formula $$R_1—(CO)_x—O—(CH(R_2)—CH_2—O)_y—(CO)_z—R_3$$

as described in Table I below were used.

TABLE I

| Component | $R_1$ | X | $R_2$ | Y | Z | $R_3$ |
|---|---|---|---|---|---|---|
| (a) | $C_4$ | 0 | 50% H/50% $CH_3$ | 4–16 | 0 | H |
| (b)-1 | $C_{17}H_{33}$ | 1 | 100% H | 15 | 1 | $C_{17}H_{33}$ |
| (b)-2 | $C_{17}H_{33}$ | 1 | 80% H/20% $CH_3$ | 9 | 0 | $CH_3$ |

For each spin finish in Comparative (abbreviated "Comp." below) A and Inventive Examples (abbreviated "Ex." below) 1 through 6, a spin finish was made with the components and in the weight percentages listed in Table II below. In Table II, MW means molecular weight and (b)-3 was a commercially available ethoxylated castor oil which contained components such as:

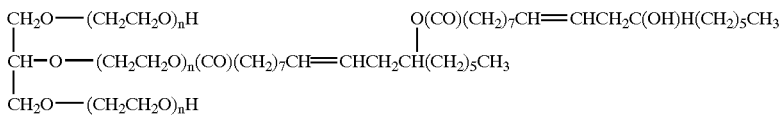

and

-continued

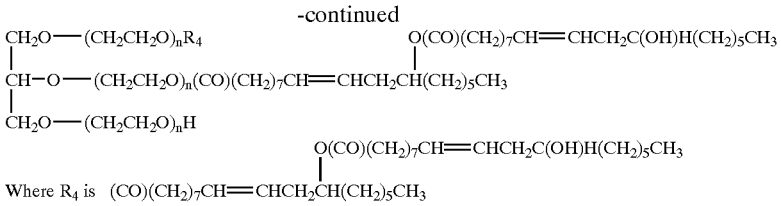

The stability of each spin finish was determined and reported in Table II below.

TABLE II

| | (a) MW~970 | (a) MW~1230 | (a) MW~1600 | (b)-1 | (b)-2 | (b)-3 + 10 EO | (b)-3 + 16 EO | (b)-3 + 25 EO | Silicone | Stable |
|---|---|---|---|---|---|---|---|---|---|---|
| Ex. 1 | 70.0 | | | 25.0 | | | | | 5.0 | Yes-fair |
| Comp. A | 70.0 | | | | | 25.0 | | | 5.0 | No |
| Ex. 2 | 70.0 | | | | 27.0 | | | | 3.0 | Yes |
| Ex. 3 | 70.0 | | | | | | 27.0 | | 3.0 | Yes |
| Ex. 4 | | 30.0 | | 65 | | | | | 5.0 | Yes |
| Ex. 5 | | | 10.0 | | | | | 85.0 | 5.0 | Yes |
| Ex. 6 | | | 10.0 | | 85.0 | | | | 5.0 | Yes |

INVENTIVE EXAMPLE 7

A spin finish having 50 weight percent component (a) as set forth in Table I above and having a molecular weight of about 270, 45 weight percent component (b)-2 as set forth in Table I above, and 5 weight percent silicone is made and is stable.

What is claimed is:

1. A process for making yarn comprising the steps of:

A. extruding polymer to make yarn;

B. to said yarn applying a spin finish composition comprising at least about 10 percent by weight based on said spin finish composition of components (a) and (b) having the formula $$R_1—(CO)_x—O—(CH(R_2)—CH_2—O)_y—(CO)_2—R_3$$

wherein each of $R_1$ and $R_3$ is selected from the group consisting of hydrogen, an alkyl group having from one to 22 carbon atoms, and an alkylene hydroxy group having one to 22 carbon atoms, x is zero or one, $R_2$ may vary within said component (a) or said component (b) and is selected from the group consisting of hydrogen and an alkyl group having from one to four carbon atoms, y is zero, or from one to 25, z is zero or one, in said component (a), x and z are equal to zero and the average molecular weight of said component (a) is less than or equal to 1,900 and if $R_2$ varies, component (a) is a random copolymer; and in said component (b), at least one of said x or z is equal to one or said component (b) is a complex polyoxyethylene glyceride-containing compound having greater than 10 polyoxyethylene units; and an alkoxylated silicone; and C. drawing said yarn.

2. The process of claim 1 wherein said component (a) is present in an amount of at least about 10 percent by weight based on said spin finish composition.

3. The process of claim 2 wherein said component (a) is present in an amount of at least about 20 percent by weight based on said spin finish composition.

4. The process of claim 3 wherein in said component (a), each of said $R_1$ and $R_3$ is selected from the group consisting of hydrogen and an alkyl group having from one to 22 carbon atoms.

5. The process of claim 4 wherein in said component (a), each of said $R_1$ and $R_3$ is selected from the group consisting of hydrogen and an alkyl group having from one to ten carbon atoms, said $R_2$ varies and is selected from the group consisting of hydrogen and an alkyl group having one or two carbon atoms, and said y is zero or from one to 20.

6. The process of claim 5 wherein in said component (a), each of said $R_1$ and $R_3$ is selected from the group consisting of hydrogen and an alkyl group having from one to five carbon atoms, said $R_2$ is selected from the group consisting of hydrogen and an alkyl group having one carbon atom, and said y is zero or from one to 16.

7. The process of claim 6 wherein the average molecular weight of said component (a) is less than about 1,500.

8. The process of claim 7 wherein said component (a) is a random copolymer.

9. The process of claim 1 wherein said component (b) is present in an amount of at least about five percent by weight based on said spin finish composition.

10. The process of claim 1 wherein said component (b) is present in an amount of at least about ten percent by weight based on said spin finish composition.

11. The process of claim 1 wherein in said component (b), each of said $R_1$ and $R_3$ is selected from the group consisting of hydrogen, an alkyl group having from one to 22 carbon atoms, and an alkylene hydroxy group having from one to 22 carbon atoms, said $R_2$ may vary and is selected from the group consisting of hydrogen, and an alkyl group having from one to four carbon atoms, and at least said x or z is equal to one.

12. The process of claim 1 wherein said component (b) is a complex polyoxyethylene glyceride-containing compound having greater than 10 polyoxyethylene units.

13. The process of claim 12 wherein said complex polyoxyethylene glyceride-containing compound is ethoxylated castor oil.

14. The process of claim 1 wherein in said step A, said polymer is polyamide.

15. The process of claim 1 wherein in said step A, said polymer is polyester.

16. The process of claim 1 wherein said in said step B, said spin finish is applied to said yarn in an amount of about 0.2 to about 1.5 percent by weight based on the weight of said yarn.

17. The process of claim 1 wherein in said step B, in said component (a), each of said $R_1$ and $R_3$ is selected from the group consisting of hydrogen or an alkyl group having from one to 22 carbon atoms, said x and z are zero, said $R_2$ may vary and is selected from the group consisting of hydrogen or an alkyl group having from one to four carbon atoms, and said y is zero, or between one to 25.

18. The process of claim 1 wherein the alkoxylated silicon comprises an ethoxylated silicon.

19. The process of claim 1 wherein the alkoxylated silicon is present in an amount of up to about five percent by weight of the spin finish composition.

20. A process for making a web comprising the steps of:

A. extruding polymer to make yarn;

B. to said yarn applying a spin finish composition comprising at least about 10 percent by weight based on said spin finish composition of components (a) and (b) having the formula $$R_1—(CO)_x—O—(CH(R_2)—CH_2—O)_y—(CO)_z—R_3$$

wherein each of $R_1$ and $R_3$ is selected from the group consisting of hydrogen, an alkyl group having from one to 22 carbon atoms, and an alkylene hydroxy group having one to 22 carbon atoms, x is zero or one, $R_2$ may vary within said component (a) or said component (b) and is selected from the group consisting of hydrogen and an alkyl group having from one to four carbon atoms, y is zero, or from one to 25, z is zero or one, in said component (a), x and z are equal to zero and the average molecular weight of said component (a) is less than or equal to 1,900 and if $R_2$ varies, component (a) is a random copolymer; and in said component (b), at least one of said x or z is equal to one or said component (b) is a complex polyoxyethylene glyceride-containing compound having greater than 10 polyoxyethylene units; and (c) an alkoxylated silicone; and C. drawing said yarn; and D. forming the yarn into a web.

* * * * *